US010053320B2

(12) United States Patent
Yamaguchi et al.

(10) Patent No.: US 10,053,320 B2
(45) Date of Patent: Aug. 21, 2018

(54) SHEET CONVEYANCE APPARATUS AND IMAGE FORMING APPARATUS

(71) Applicant: CANON KABUSHIKI KAISHA, Tokyo (JP)

(72) Inventors: Hiroki Yamaguchi, Yokohama (JP); Masanobu Kanoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/263,875

(22) Filed: Sep. 13, 2016

(65) Prior Publication Data

US 2017/0096310 A1 Apr. 6, 2017

(30) Foreign Application Priority Data

Oct. 2, 2015 (JP) ..... 2015-196504

(51) Int. Cl.
*B65H 5/06* (2006.01)
*B65H 9/16* (2006.01)
(Continued)

(52) U.S. Cl.
CPC ..... *B65H 9/166* (2013.01); *B65H 5/062* (2013.01); *B65H 29/125* (2013.01); *B65H 29/14* (2013.01);
(Continued)

(58) Field of Classification Search
CPC ..... B65H 5/06; B65H 5/062; B65H 5/064; B65H 9/166; B65H 29/12; B65H 29/125;
(Continued)

(56) References Cited

U.S. PATENT DOCUMENTS 4,188,109 A * 2/1980 Idenawa ..... G03G 15/2092 219/216
4,589,654 A 5/1986 Kanoto
(Continued)

FOREIGN PATENT DOCUMENTS

CN 1530306 A 9/2004
CN 1721305 A 1/2006
(Continued)

OTHER PUBLICATIONS

Office Action dated Jun. 4, 2018, in Chinese Patent Application No. 201610871008.4.

*Primary Examiner* — Ernesto A Suarez
(74) *Attorney, Agent, or Firm* — Fitzpatrick, Cella, Harper & Scinto

(57) ABSTRACT

The sheet conveyance apparatus includes first and second rollers, the second roller coming into contact with the first roller and thereby forming a nip portion, the second rotation axis being inclined with respect to the first rotation axis, wherein the second roller includes a first outer circumferential portion having a first outside diameter, a second outer circumferential portion arranged on one side of the first outer circumferential portion in an axial direction of the second rotation axis and having a second outside diameter larger than the first outside diameter, and a third outer circumferential portion arranged on the other side of the first outer circumferential portion, and wherein an outer circumferential surface of the first roller contacts with at least the first, second and third outer circumferential portions of the second roller, to form the nip portion.

12 Claims, 8 Drawing Sheets

(51) Int. Cl.
*B65H 29/12* (2006.01)
*B65H 29/14* (2006.01)

(52) U.S. Cl.
CPC ..... *B65H 2301/51242* (2013.01); *B65H 2404/1313* (2013.01); *B65H 2404/1314* (2013.01); *B65H 2404/1321* (2013.01); *B65H 2404/13161* (2013.01); *B65H 2404/141* (2013.01); *B65H 2601/254* (2013.01); *B65H 2801/06* (2013.01)

(58) Field of Classification Search
CPC .. B65H 2301/3412; B65H 2301/44318; B65H 2301/5121; B65H 2301/5122; B65H 2301/5124; B65H 2301/5125; B65H 2301/51256; B65H 2404/10; B65H 2404/11; B65H 2404/111; B65H 2404/13; B65H 2404/131; B65H 2404/1311; B65H 2404/1312; B65H 2404/1313; B65H 2404/1316; B65H 2404/1317; B65H 2404/13171; B65H 2404/1341; B65H 2404/1345; B65H 2404/143; B65H 2404/1431
See application file for complete search history.

(56) References Cited

U.S. PATENT DOCUMENTS

| | | | | |
|---|---|---|---|---|
| 5,143,366 | A * | 9/1992 | Svyatsky | B65H 5/062 271/122 |
| 5,186,448 | A | 2/1993 | Ohsawa et al. | |
| 5,640,649 | A | 6/1997 | Kikuchi et al. | |
| 5,793,399 | A | 8/1998 | Kawakami et al. | |
| 5,867,196 | A | 2/1999 | Kiyohara et al. | |
| 5,886,729 | A | 3/1999 | Hiramatsu et al. | |
| 5,899,451 | A | 5/1999 | Kiyohara et al. | |
| 5,992,993 | A | 11/1999 | Kiyohara et al. | |
| 6,045,220 | A | 4/2000 | Kiyohara et al. | |
| 6,330,419 | B1 * | 12/2001 | Sano | B65H 29/12 219/216 |
| 7,500,670 | B2 | 3/2009 | Kitazawa | |
| 7,661,674 | B2 * | 2/2010 | Izuchi | B65H 5/062 271/188 |
| 7,828,292 | B2 | 11/2010 | Kitazawa | |
| 9,132,989 | B2 * | 9/2015 | Norikane | B65H 85/00 |
| 9,280,118 | B2 | 3/2016 | Endo | |
| 9,517,906 | B2 | 12/2016 | Nishimura | |
| 9,588,476 | B2 | 3/2017 | Endo | |
| 2004/0135310 | A1 * | 7/2004 | Yang | B65H 9/166 271/226 |
| 2004/0178571 | A1 | 9/2004 | Ohama et al. | |
| 2008/0247797 | A1 * | 10/2008 | Yoshino | B65H 29/12 399/406 |
| 2012/0183338 | A1 * | 7/2012 | Kanai | B65H 5/062 399/361 |
| 2014/0064812 | A1 * | 3/2014 | Liu | B41J 13/025 399/361 |
| 2017/0001825 | A1 * | 1/2017 | Baek | B65H 27/00 |
| 2017/0008713 | A1 * | 1/2017 | Yamaguchi | G03G 15/6529 |

FOREIGN PATENT DOCUMENTS

| | | | |
|---|---|---|---|
| CN | 101288863 | A | 10/2008 |
| CN | 102976125 | A | 3/2013 |
| CN | 103662894 | A | 3/2014 |
| CN | 104555518 | A | 4/2015 |
| JP | S63-272742 | A | 11/1988 |
| JP | S64-64943 | A | 3/1989 |
| JP | H05-107984 | A | 4/1993 |
| JP | H11-311893 | A | 11/1999 |
| JP | 2002-226077 | A | 8/2002 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus adapted to convey a sheet as well as to an image forming apparatus equipped with the sheet conveyance apparatus.

Description of the Related Art

Generally, an image forming apparatus such as an electrophotographic copier transfers a toner image to a sheet and fixes the transferred toner image onto the sheet by applying heat and pressure using a fixing device. Then, after passing through the fixing device, the sheet is discharged out of the apparatus by a discharge roller pair.

Japanese Patent Application Laid-Open No. H11-311893 proposes a printer in which a discharge roller pair includes a conveyance roller driven by a motor, and a pinch roller placed by being inclined at a predetermined angle to a rotation axis of the conveyance roller and adapted to rotate following the conveyance roller.

However, in the printer described above, when the conveyance roller and pinch roller are cylindrical, the conveyance roller and pinch roller contact each other only at a single point. In this way, when the conveyance roller and pinch roller making up a roller pair adapted to convey a sheet have a small number of contact points, sheet holding force will be impaired, resulting in a reduced conveying force, and sheet conveyance will become unstable. Also, nip pressure between the conveyance roller and pinch roller will concentrate on the single point, and the sheet might be creased, scarred, or otherwise damaged.

SUMMARY OF THE INVENTION

According to a first aspect of the present invention, a sheet conveyance apparatus includes a first roller configured to rotate around a first rotation axis; and a second roller configured to rotate around a second rotation axis, the second roller coming into contact with the first roller and thereby forming a nip portion in which a sheet is conveyed, the second rotation axis being inclined with respect to the first rotation axis, wherein the second roller includes a first outer circumferential portion having a first outside diameter, a second outer circumferential portion arranged on one side of the first outer circumferential portion in an axial direction of the second rotation axis and having a second outside diameter larger than the first outside diameter, and a third outer circumferential portion arranged on the other side of the first outer circumferential portion in the axial direction of the second rotation axis and having a third outside diameter larger than the first outside diameter, and wherein an outer circumferential surface of the first roller contacts with at least the first outer circumferential portion, the second outer circumferential portion, and the third outer circumferential portion of the second roller, to form the nip portion.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

[Overall Configuration]

Figure 1:
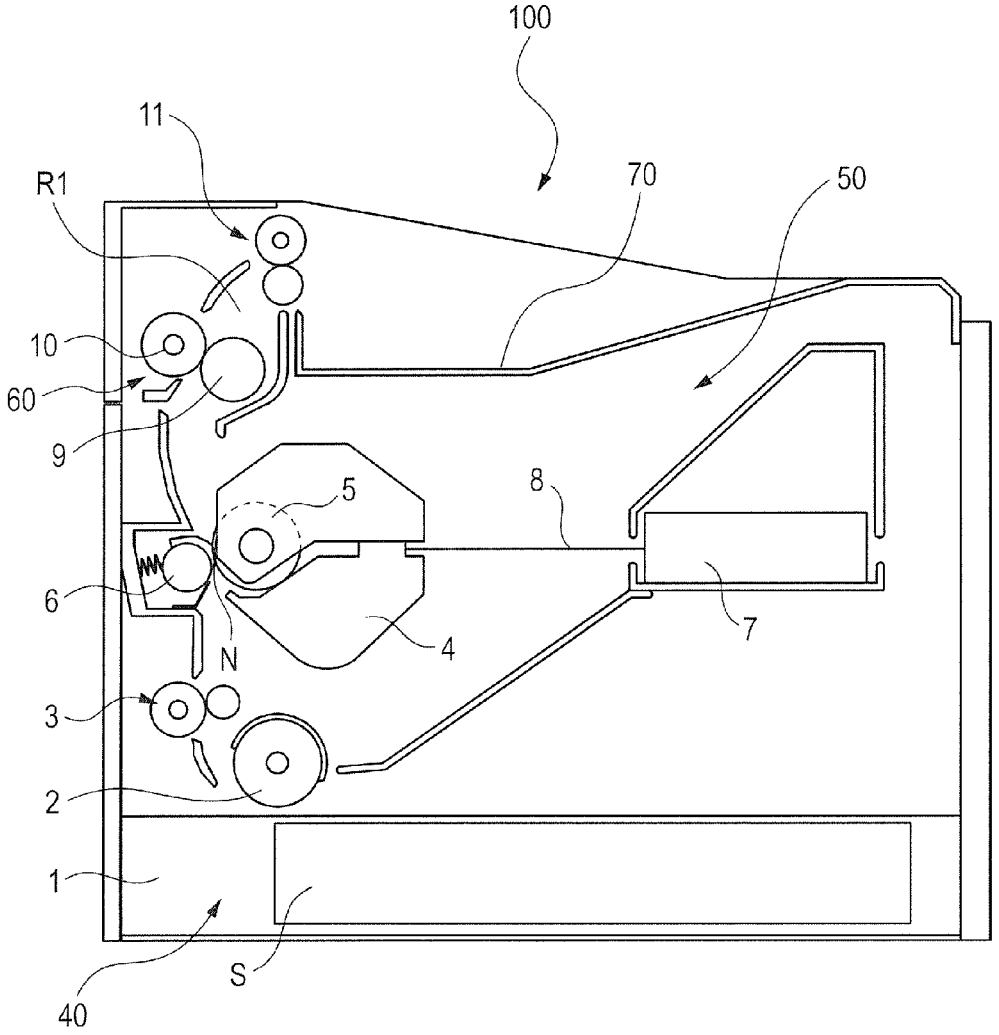
FIG. 1 is an overall schematic diagram showing a printer according to a first embodiment.

First, a first embodiment of the present invention will be described. A printer 100 (image forming apparatus) according to the first embodiment is a laser beam printer of an electrophotography type. As shown in FIG. 1, the printer 100 includes a sheet feeding unit 40 adapted to feed a sheet S, an image forming unit 50 adapted to form an image on the sheet S, a fixing device 60 (fixing unit), and a discharge unit 11 adapted to discharge the sheet S out of the printer.

The sheet feeding unit 40 includes a cassette 1 loaded with sheets S, a sheet feeding roller 2 adapted to feed sheets S loaded in the cassette 1, and a separation unit (not shown) made up, for example, of a separation roller. The image forming unit 50 includes a photosensitive drum 5, an electrostatic charger, a developing apparatus, a cleaning apparatus, a cartridge 4 provided with a toner container, and a laser scanner 7 adapted to irradiate the photosensitive drum 5 with a laser beam. Also, the image forming unit 50 includes a transfer roller 6 adapted to form a transfer nip N (transfer unit) in conjunction with the photosensitive drum 5. The cartridge 4 is detachably attached to the printer 100.

When an image forming signal is input to the printer 100, the laser scanner 7 irradiates the photosensitive drum 5, which has been charged uniformly by the electrostatic charger, with a laser beam 8 based on image information transmitted from an external PC or scanner. An electrostatic latent image formed on the photosensitive drum 5 by the laser beam 8 is developed into a toner image by the developing apparatus.

Concurrently with an image forming process of the image forming unit 50, the sheets S loaded in the cassette 1 are fed one by one by being separated by the sheet feeding roller 2 and separation unit. The sheets S fed by the sheet feeding unit 40 are conveyed to the transfer nip N by the intermediate conveyance unit 3 made up of a roller pair or the like. The toner image formed on the photosensitive drum 5 is transferred to the sheets in the transfer nip N. Toner remaining on the photosensitive drum 5 is collected by the cleaning apparatus.

Heat and pressure are applied by the fixing roller 9 and a pressure roller 10 of the fixing device 60 to the sheets S to which the toner image has been transferred, and consequently the toner image is fixed thereto. The sheets S with the toner image fixed thereto are discharged out of the printer to an output tray 70 by the discharge unit 11 placed downstream of the fixing device 60 in a sheet conveying direction.

[Discharge Unit]

Figure 2:
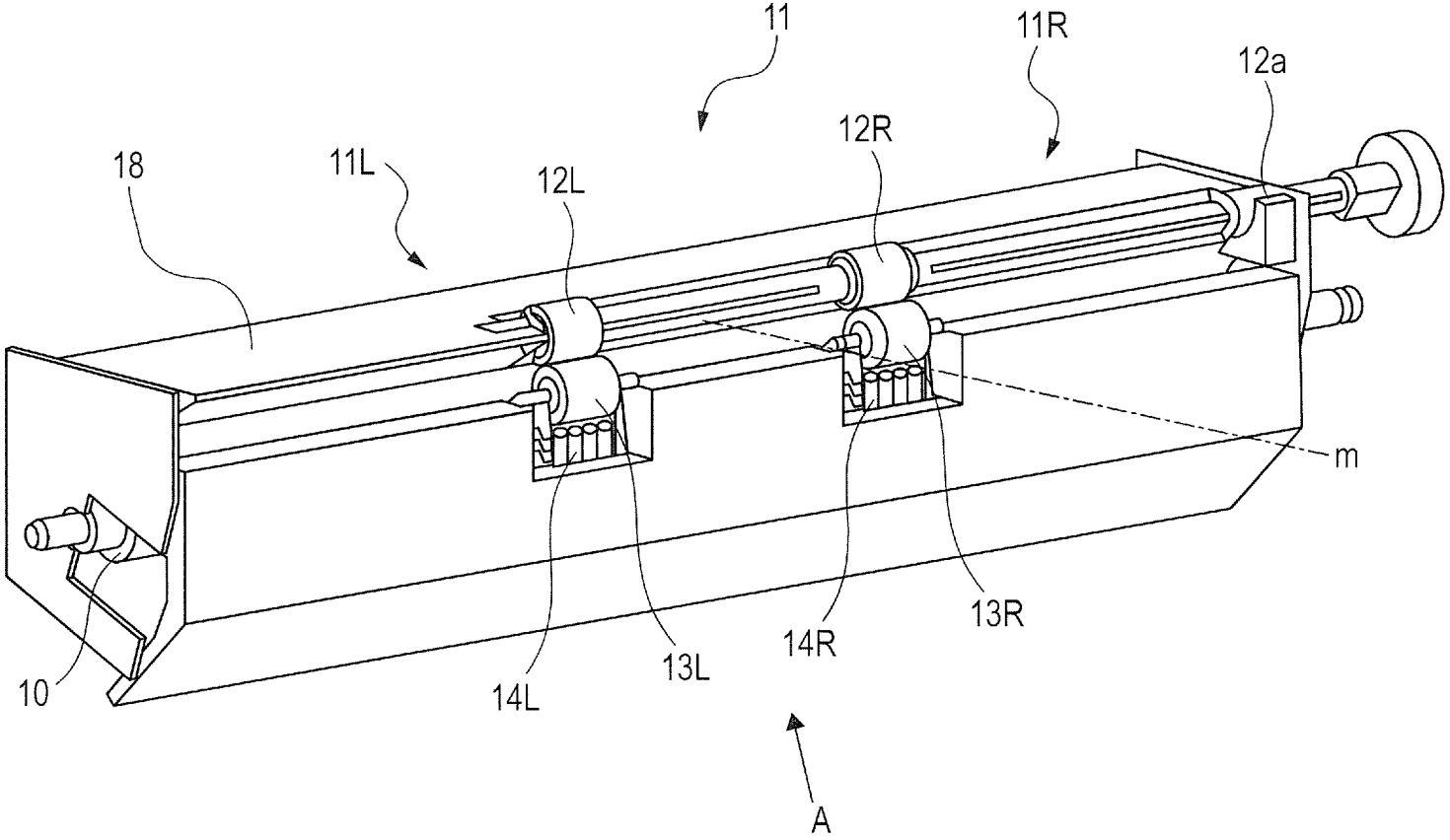
FIG. 2 is a perspective view showing a discharge unit.

Next, a configuration of the discharge unit 11 (sheet conveyance apparatus) will be described in detail. As shown in FIG. 2, the discharge unit 11 includes an upper frame 18 of the printer 100 as well as plural (two according to the present embodiment) discharge roller pairs 11L (first conveyance unit) and 11R (second conveyance unit) supported by the upper frame 18. The discharge roller pairs 11L and 11R are placed symmetrically with respect to a center line (center) m in a sheet width direction orthogonal to the sheet conveying direction. The discharge roller pair 11L will mainly be described below and description of the discharge roller pair 11R similar in configuration to the discharge roller pair 11L will be omitted as appropriate.

Figure 3:
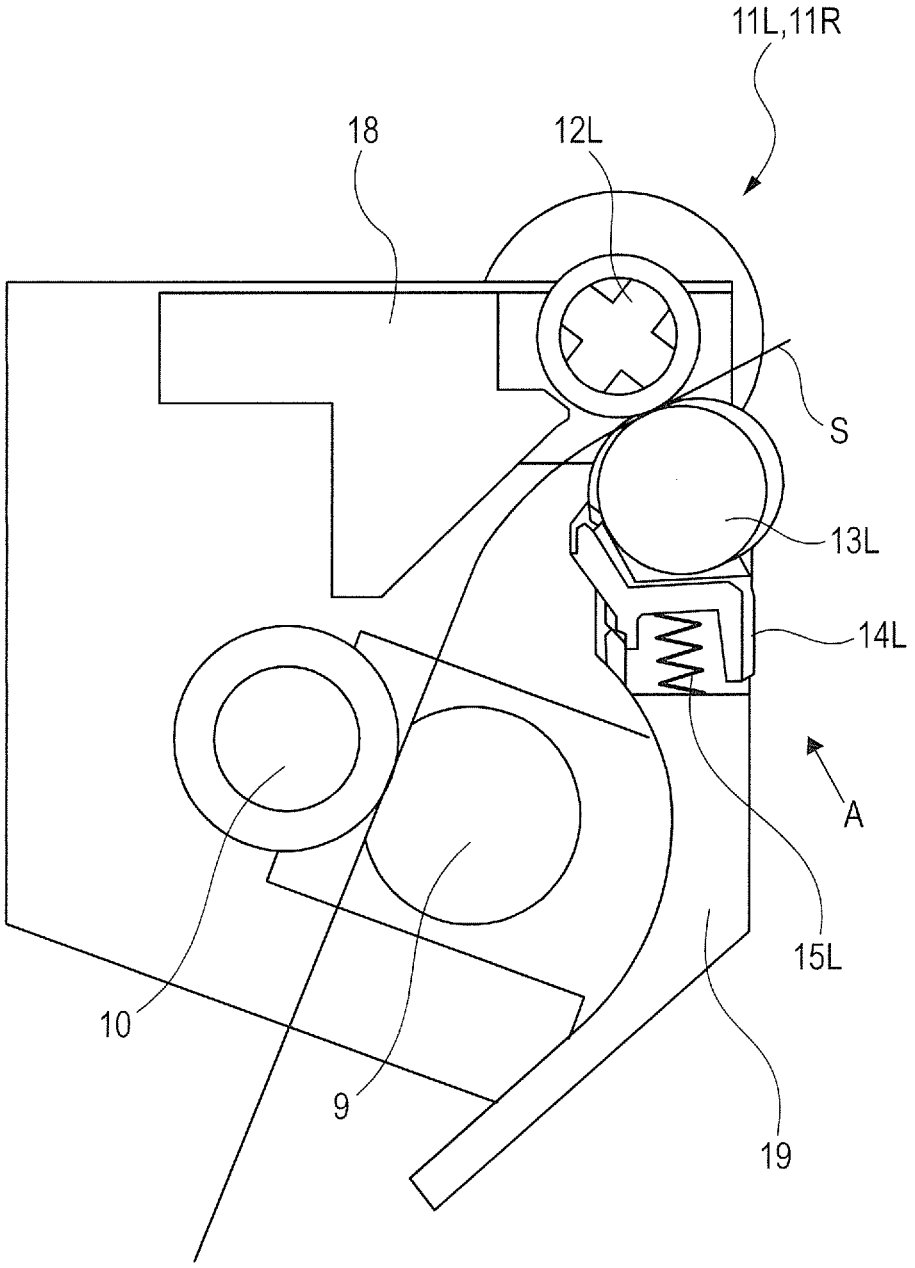
FIG. 3 is side view showing the discharge unit.

As shown in FIG. 3, the discharge roller pair 11L includes a discharge roller 12L (first roller) fixed to a rotating shaft 12*a* driven by a non-illustrated motor (driving source) and an idle roller 13L (second roller) rotatably supported by a holding member 14L. The discharge roller 12L is formed of rubber and the idle roller 13L is formed, for example, of resin such as polyacetal resin. The idle roller 13L is placed on an inner side of a curved conveying path R1 (curving conveying path) between the fixing device 60 and discharge unit 11. A spring 15L is installed in a compressed state between the holding member 14L and the lower frame 19 of the printer 100, and the idle roller 13L is placed in pressure contact with the discharge roller 12L by a biasing force of the spring 15L.

Note that a discharge roller 12R (third roller) of the discharge roller pair 11R is fixed to the rotating shaft 12*a* in such a way as to be coaxial with the discharge roller 12L. An idle roller 13R (fourth roller) is rotatably supported by the upper frame 18 via a holding member 14R separately from the idle roller 13L.

When the rotating shaft 12*a* is driven by the motor (not shown), the discharge rollers 12L and 12R rotate and the idle rollers 13L and 13R placed in pressure contact with the discharge rollers 12L and 12R rotate by being driven by driving forces of the discharge rollers 12L and 12R.

[Arrangement of Idle Rollers]

Figure 4:
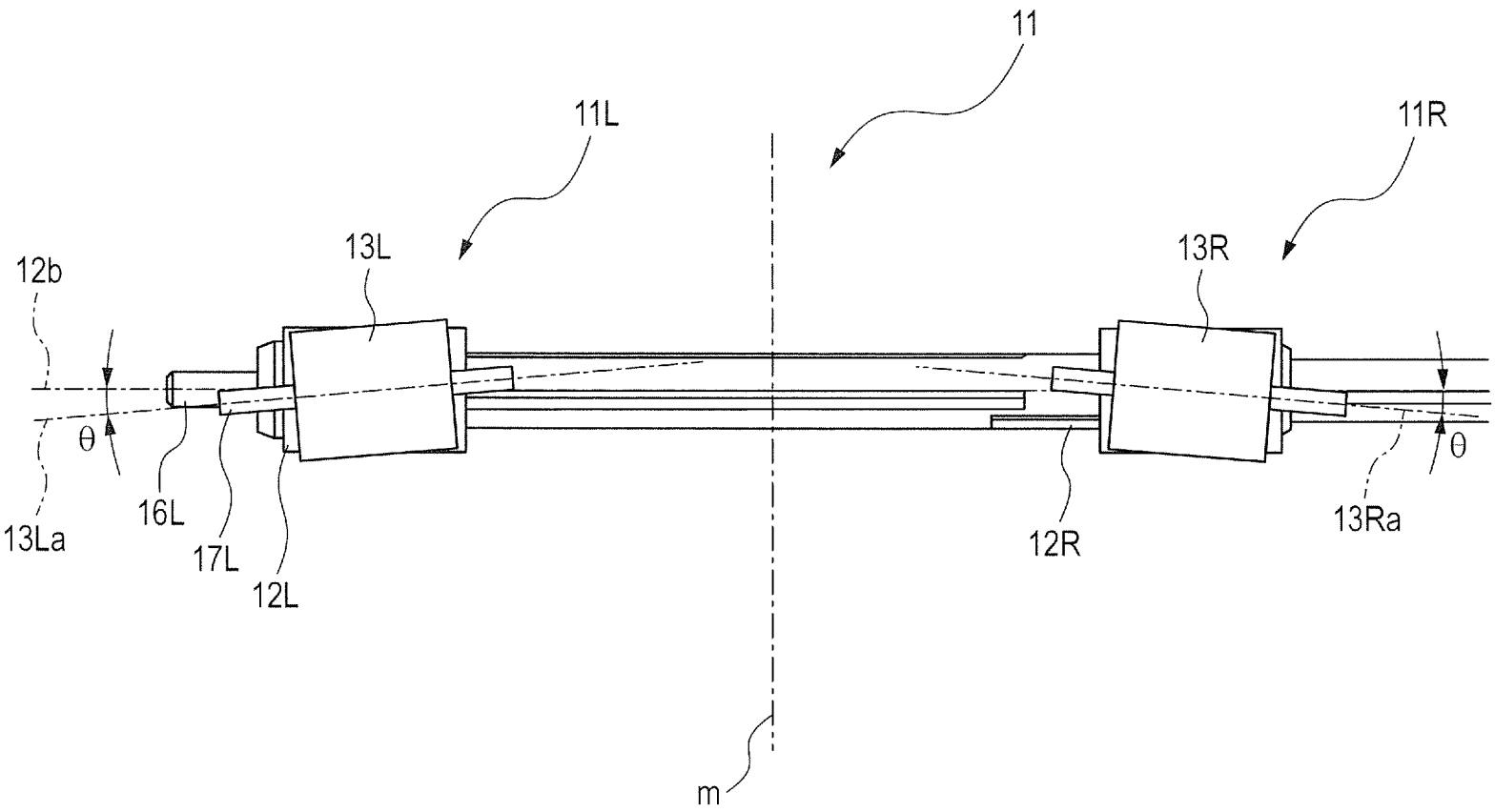
FIG. 4 is a diagram of the discharge unit as viewed in direction A of FIG. 2.

Next, arrangement of the idle rollers 13L and 13R will be described in detail. FIG. 4 is a diagram of the discharge unit 11 as viewed in a direction of pressure contact (nip direction, i.e., direction A in FIG. 2) of the idle roller 13L with the discharge roller 12L. As shown in FIG. 4, the idle roller 13L is placed by being inclined at an angle θ to a rotation axis 12*b* (first axis) of the discharge roller 12L when viewed in the pressure contact direction. That is, a rotation axis 13La (second axis) of the idle roller 13L is placed by being inclined at the angle θ to the rotation axis 12*b* of the discharge roller 12L. Similarly, a rotation axis 13Ra (third axis) of the idle roller 13R is placed by being inclined at the angle θ to the rotation axis 12*b* of the discharge roller 12R. A rotation axis 13La and rotation axis 13Ra are inclined further toward the sheet conveying direction with decreasing distance to the center line m of the sheet.

The idle rollers 13L and 13R are installed symmetrically with respect to the center line m at a center of the conveying path along which the sheet is conveyed, by being inclined outward with respect to the sheet conveying direction. As the idle rollers 13L and 13R are placed at an inclination, the sheet S is stretched outward on both sides, thereby preventing the sheet S from being creased while being conveyed in the discharge unit 11.

[Shape of Idle Rollers]

Figure 5:
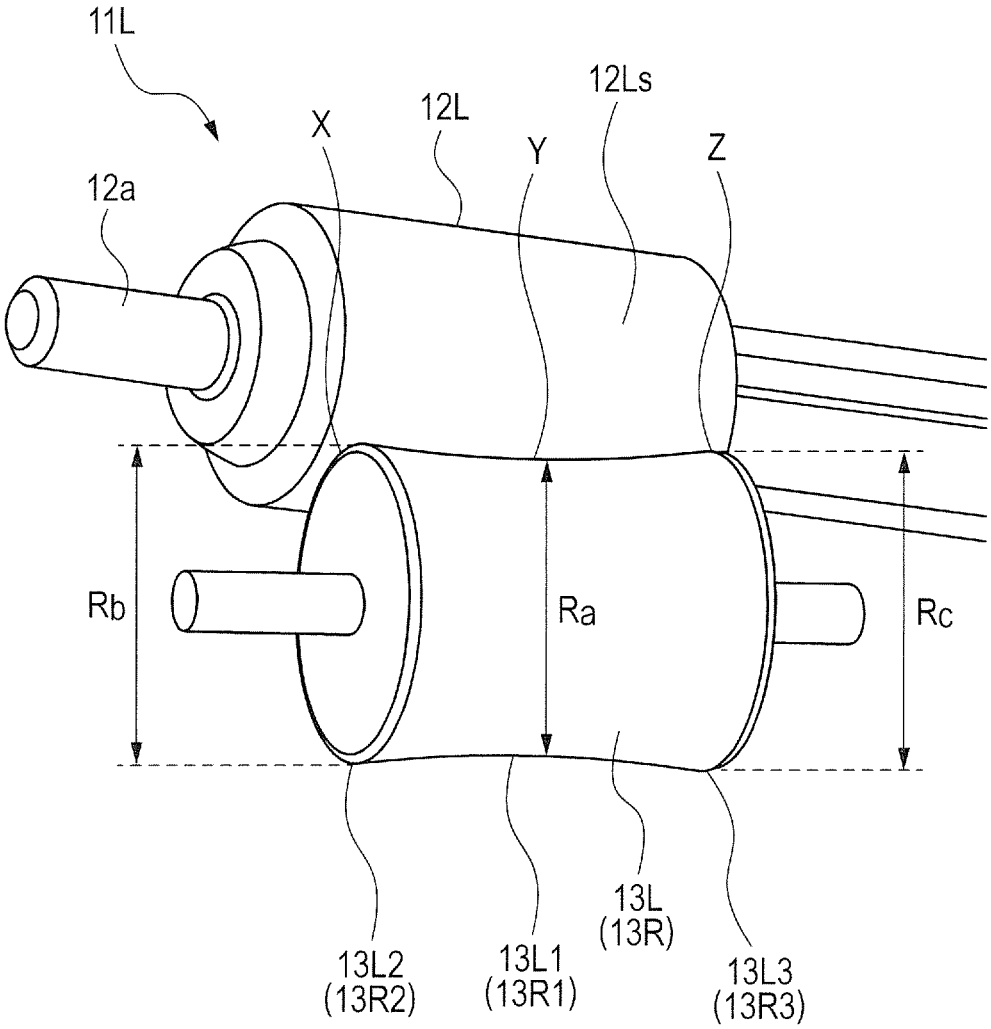
FIG. 5 is an enlarged perspective view showing a discharge roller pair.

Next, shape of the idle rollers 13L and 13R will be described in detail. As shown in FIG. 5, the idle roller 13L includes a first outer circumferential portion 13L1 having a first outside diameter Ra, a second outer circumferential portion 13L2 having a second outside diameter Rb, and a third outer circumferential portion 13L2 having a third outside diameter Rc.

The first outer circumferential portion 13L1 is located in an approximate center portion of the idle roller 13L in an axial direction, and the second outer circumferential portion 13L2 and third outer circumferential portion 13L3 are located, respectively, on edges of the idle roller 13L in the axial direction. That is, the second outer circumferential portion 13L2 is placed on one side of the first outer circumferential portion 13L1 in the axial direction and the third outer circumferential portion 13L3 is placed on another side of the first outer circumferential portion 13L1 in the axial direction.

The first outside diameter Ra is set smaller than the second outside diameter Rb and third outside diameter Rc, and the second outside diameter Rb and third outside diameter Rc are set equal to each other (Ra<Rb=Rc). Also, the idle roller 13L is formed continuously, gradually increasing in outside diameter from the first outer circumferential portion 13L1 toward the second outer circumferential portion 13L2 as well as from the first outer circumferential portion 13L1 toward the third outer circumferential portion 13L3. Then, the idle roller 13L is formed into a so-called reverse camber shape or hourglass shape as a whole, being depressed in a central portion in the axial direction and gradually increasing in outside diameter toward opposite ends.

Note that the idle roller 13R has a configuration similar to that of the idle roller 13L and includes a fourth outer circumferential portion 13R1, a fifth outer circumferential portion 13R2, and a sixth outer circumferential portion 13R3 as shown in FIG. 5.

The idle roller 13L, which has the arrangement and shape described above, abuts (contacts) an outer circumferential surface 12Ls of the discharge roller 12L on at least the first outer circumferential portion 13L1, second outer circumferential portion 13L2 and third outer circumferential portion 13L3. In the present embodiment, the idle roller 13L forms a nip portion to convey the sheet by abutting the outer circumferential surface 12Ls of the discharge roller 12L, for example, at contact points X, Y, and Z.

This allows the idle roller 13L to contact the discharge roller 12L at three or more points, increasing a sheet conveying force during conveyance of the sheet and enabling stable sheet conveyance. Also, nip pressure between the discharge roller 12L and idle roller 13L is distributed over the three contact points X, Y, and Z, reducing damage such as creases and scars left on the sheet.

Also, since the discharge roller 12L is placed by being inclined obliquely with respect to the idle roller 13L, high-temperature toner on the sheet passing through the fixing device 60 comes into sliding contact with the idle roller 13L, preventing the toner from sticking in clumps to the idle roller 13L. Recently, in particular, melting points of toner have been becoming lower and image forming processes have been becoming faster, creating an environment in which toner is prone to attach to the idle roller 13L, but the present embodiment can prevent this.

Also, in the nip of the discharge roller pair 11L, the sheet winds itself around the discharge roller 12L, which is formed of rubber, and an effect of the winding can further increase the conveying force. The sheet passing through the fixing device 60 is prone to curl because moisture content in the sheet changes as well as because the sheet passes through the curved conveying path R1. However, since the sheet winds itself around the discharge roller 12L, the curl formed on the sheet S passing through the fixing device 60 can be removed. Note that the above effect works not only on the discharge roller pair 11L, but also on the discharge roller pair 11R in a similar manner.

Note that in the present embodiment, the outside diameters of the idle rollers 13L and 13R are formed continuously by changing gradually, but this is not restrictive. That is, the idle rollers may be configured to have a stepped section when viewed in a radial direction of the rollers.

Also, in the present embodiment, the outside diameter Rb of the second outer circumferential portion 13L2 and outside diameter Rc of the third outer circumferential portion 13L3 are set equal to each other, but may be set different from each other.

Second Embodiment

Next, a second embodiment of the present invention will be described. The second embodiment is configured by applying the idle rollers 13L and 13R according to the first embodiment to the intermediate conveyance unit 3. Thus, the same components as those in the first embodiment will be described by denoting with the same reference numerals as the corresponding components in the first embodiment or illustration thereof will be omitted.

[Intermediate Conveyance Unit]

Figure 6:
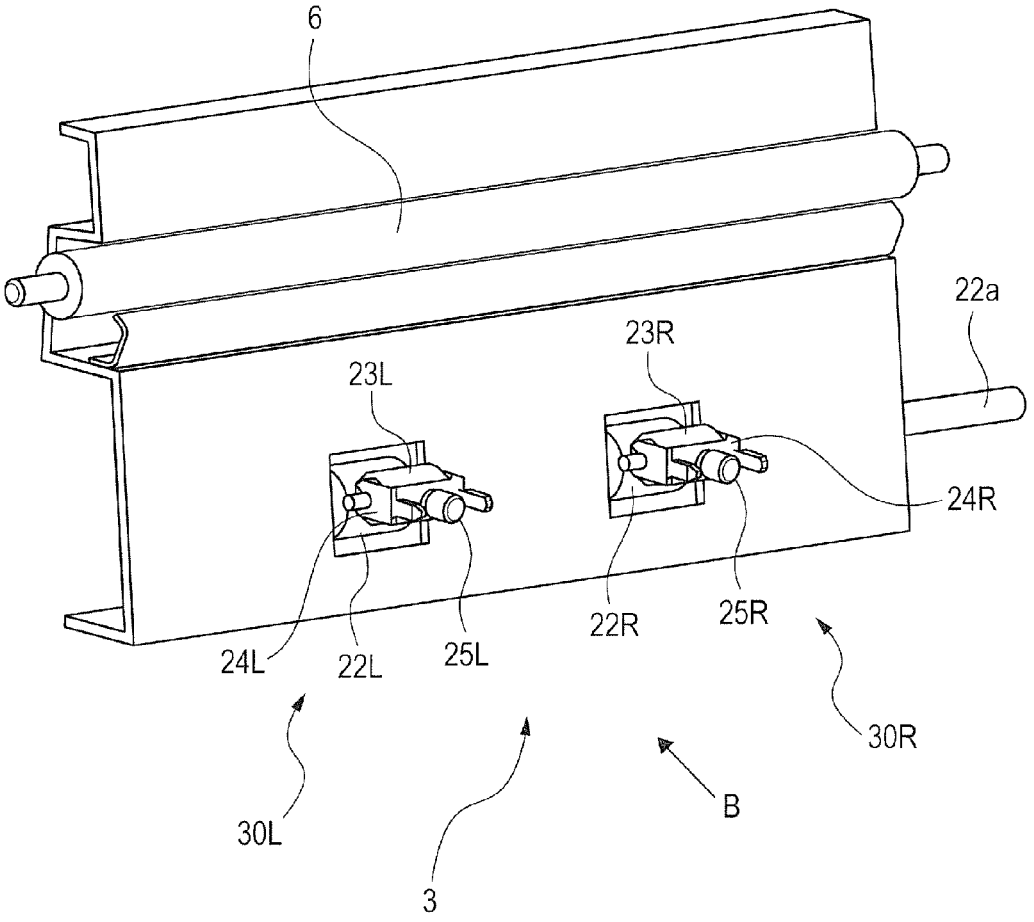
FIG. 6 is a perspective view showing an intermediate conveyance unit according to a second embodiment.

The intermediate conveyance unit 3 (sheet conveyance apparatus) is installed upstream of the transfer nip N in the sheet conveying direction (see FIG. 1) and equipped with plural (two according to the present embodiment) intermediate conveyance roller pairs 30L and 30R placed in the width direction as shown in FIG. 6. The intermediate conveyance roller pairs 30L and 30R are installed symmetrically with respect to the center line m in the width direction. The intermediate conveyance roller pair 30L will mainly be described below and description of the intermediate conveyance roller pair 30R similar in configuration to the intermediate conveyance roller pair 30L will be omitted as appropriate.

Figure 7:
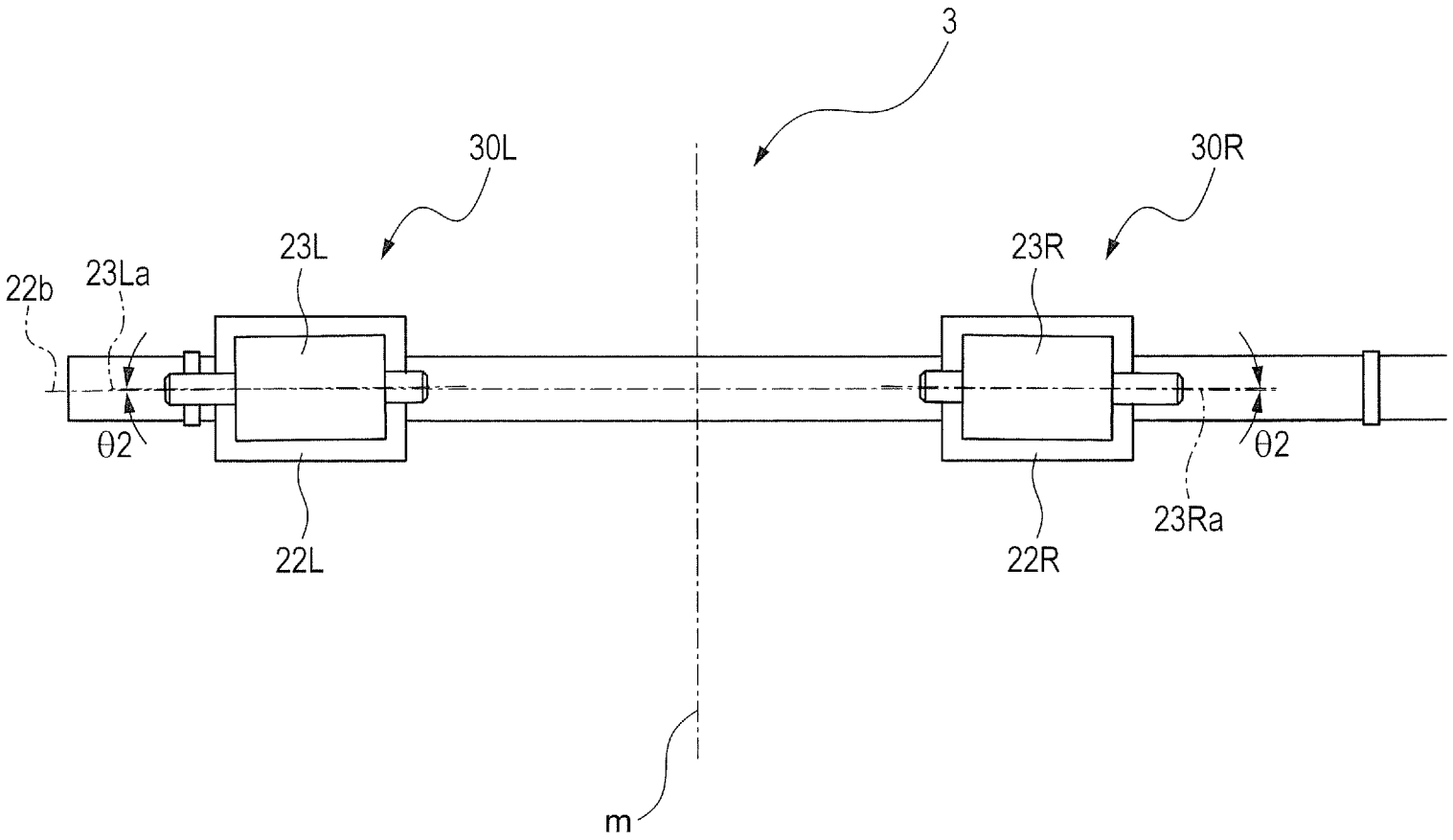
FIG. 7 is a diagram of the intermediate conveyance unit as viewed in direction B of FIG. 6.

As shown in FIGS. 6 and 7, the intermediate conveyance roller pair 30L includes an intermediate conveyance roller 22L fixed to a rotating shaft 22*a* driven by a motor (not shown) and an idle roller 23L rotatably supported by a holding member 24L. The intermediate conveyance roller 22L is formed of rubber and the idle roller 23L is formed, for example, of resin such as polyacetal resin. The holding member 24L is biased toward the intermediate conveyance roller 22L by a spring 25L and the idle roller 23L is placed in pressure contact with the intermediate conveyance roller 22L by a biasing force of the spring 25L.

When the rotating shaft 22*a* is driven by the motor (not shown), the intermediate conveyance rollers 22L and 22R rotate and the idle rollers 23L and 23R placed in pressure contact with the intermediate conveyance rollers 22L and 22R rotate by being driven by driving forces of the intermediate conveyance rollers 22L and 22R.

[Arrangement and Shape of Idle Rollers]

Next, arrangement of the idle rollers 23L and 23R will be described in detail. FIG. 7 is a diagram of the intermediate conveyance unit 3 as viewed in a direction of pressure contact (nip direction, i.e., direction B in FIG. 6) of the idle roller 23L with the intermediate conveyance roller 22L. As shown in FIG. 7, the idle roller 23L is placed by being inclined at an angle θ2 to a rotation axis 22*b* of the intermediate conveyance roller 22L when viewed in the pressure contact direction. That is, a rotation axis 23La of the idle roller 23L is placed by being obliquely inclined at the angle θ2 to the rotation axis 22*b* of the intermediate conveyance roller 22L.

Similarly, a rotation axis 23Ra of the idle roller 23R is placed by being obliquely inclined at the angle θ2 to the rotation axis 22*b* of an intermediate conveyance roller 22R. The idle rollers 23L and 23R are installed symmetrically with respect to the center line m at a center of the conveying path along which the sheet is conveyed, by being slightly inclined outward with respect to the sheet conveying direction.

Also, as with the idle rollers 13L and 13R according to the first embodiment, each of the idle rollers 23L and 23R is formed into a so-called reverse camber shape or hourglass shape as a whole, being depressed in a central portion in the axial direction and gradually increasing in outside diameter toward opposite ends.

Since the idle rollers 23L and 23R are symmetric to each other with respect to the center line m and slightly inclined outward with respect to the sheet conveying direction as described above, the idle rollers 23L and 23R are prevented from both being inclined in the same direction due to parts tolerances. Consequently, the sheet S can be conveyed straight through the transfer nip N, preventing the image from being transferred obliquely to the sheet S.

Also, since the idle roller 23L is formed into a reverse camber shape, the idle roller 23L can contact the intermediate conveyance roller 22L at three or more points, increasing the sheet conveying force during conveyance of the sheet. This enables stable sheet conveyance. Also, nip pressure between the intermediate conveyance roller 22L and idle roller 23L is distributed, reducing damage such as creases and scars left on the sheet. Note that the above effect works not only on the intermediate conveyance roller pair 30L, but also on the intermediate conveyance roller pair 30R in a similar manner.

Third Embodiment

Next, a third embodiment of the present invention will be described. The third embodiment is configured by changing the shape of the idle rollers 13L and 13R according to the first embodiment. Thus, the same components as those in the first embodiment will be described by denoting with the same reference numerals as the corresponding components in the first embodiment or illustration thereof will be omitted.

[Arrangement and Shape of Idle Rollers]

Figure 8:
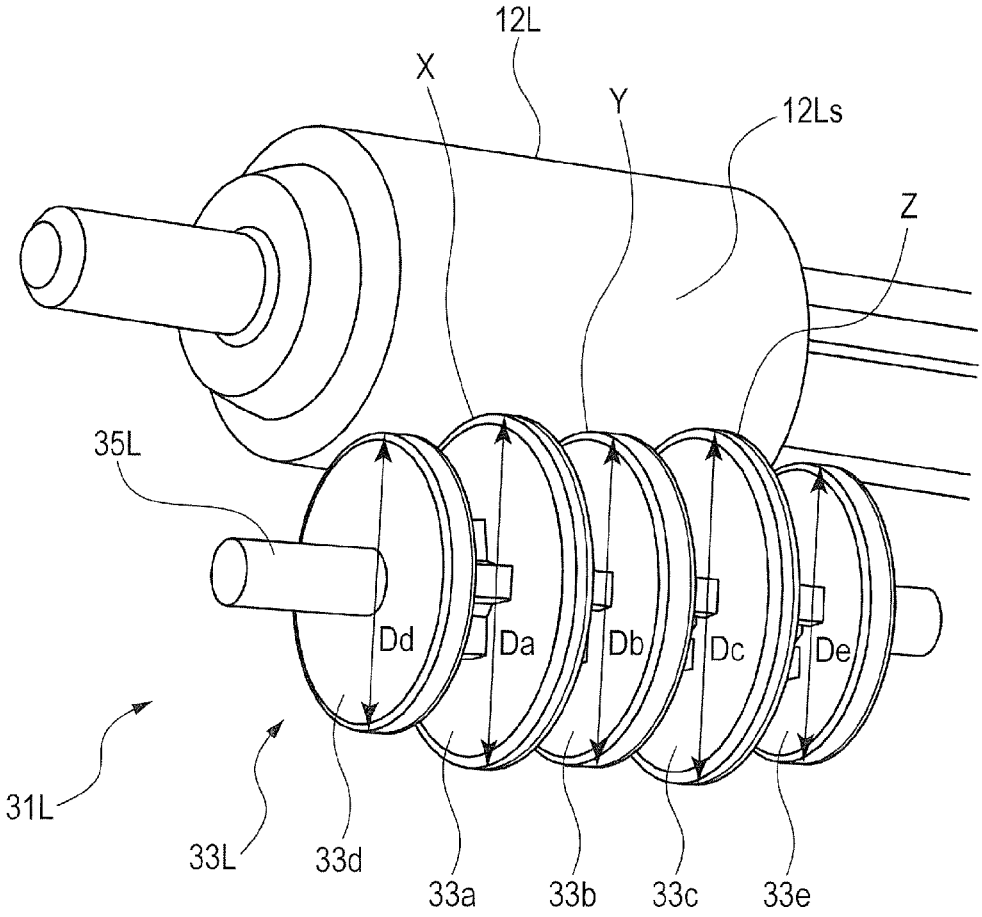
FIG. 8 is an enlarged perspective view showing an idle roller according to a third embodiment.

As shown in FIG. 8, a discharge roller pair 31L includes a discharge roller 12L cylindrical in shape and an idle roller 33L adapted to abut the discharge roller 12L. The idle roller 33L is placed by being obliquely inclined with respect to the discharge roller 12L.

The idle roller 33L includes a first disk portion 33*b*, a second disk portion 33*a*, a third disk portion 33*c*, a fourth disk portion 33*d* and a fifth disk portion 33*e* fixed to a rotating shaft 35L and each formed into a disk shape. A vacant space is provided between each pair of adjacent disk portions from among the first disk portion 33*b*, second disk portion 33*a*, third disk portion 33*c*, fourth disk portion 33*d* and fifth disk portion 33*e*.

The first disk portion 33*b* (first outer circumferential portion) is located in an approximate center portion of the idle roller 33L in the axial direction, and the second disk portion 33*a* (second outer circumferential portion) and third disk portion 33*c* (third outer circumferential portion) are placed on opposite sides of the first disk portion 33*b* in the axial direction. The fourth disk portion 33*d* (first small-diameter portion) is placed on the opposite side of the first disk portion 33*b* from the second disk portion 33*a* and the fifth disk portion 33*e* (second small-diameter portion) is placed on the opposite side of the first disk portion 33*b* from the third disk portion 33*c*.

An outside diameter Db of the first disk portion 33*b* is set smaller than an outside diameter Da of the second disk portion 33*a* and an outside diameter Dc of the third disk portion 33*c*, and the outside diameter Da of the second disk portion 33*a* and the outside diameter Dc of the third disk portion 33*c* are set equal to each other (Db<Da=Dc). Also, an outside diameter Dd of the fourth disk portion 33*d* is set smaller than the outside diameter Da of the adjacent second disk portion 33*a* and an outside diameter De of the fifth disk portion 33*e* is set smaller than the outside diameter Dc of the adjacent third disk portion 33*c* (Dd<Da; De<Dc).

The idle roller 33L, which has the arrangement and shape described above, abuts the outer circumferential surface 12Ls of the discharge roller 12L on at least the first disk portion 33*b*, second disk portion 33*a* and third disk portion 33*c*. In the present embodiment, the idle roller 33L abuts the outer circumferential surface 12Ls of the discharge roller 12L, for example, at contact points X, Y and Z.

This allows the idle roller 33L to contact the discharge roller 12L at three or more points, increasing the sheet conveying force during conveyance of the sheet and enabling stable sheet conveyance. Also, nip pressure between the discharge roller 12L and idle roller 33L is distributed over the three contact points X, Y and Z, reducing damage such as creases and scars left on the sheet.

Also, since the outside diameters Dd and De of the fourth disk portion 33*d* and fifth disk portion 33*e* are set smaller than the outside diameters Da and Dc of the second disk portion 33*a* and third disk portion 33*c*, the fourth disk portion 33*d* and fifth disk portion 33*e* do not come into contact with the discharge roller 12L. That is, even if the idle roller 33L is inclined with respect to the discharge roller 12L, the sheet does not come locally into contact with the fourth disk portion 33*d* and fifth disk portion 33*e*. This prevents formation of streaks on the sheet.

Also, the idle roller 33L, which is formed of plural disk portions, can be mold-formed relatively easily and produced at low costs.

Note that the reverse camber idle rollers applied to the discharge unit 11 and intermediate conveyance unit 3 in the first to third embodiments may be applied in other places.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-196504, filed Oct. 2, 2015, which is hereby incorporated by reference herein in its entirety.

What is claimed is:

1. A sheet conveyance apparatus, comprising:

a first conveyance unit having:

a first roller configured to rotate around a first rotation axis; and a second roller configured to rotate around a second rotation axis, the second roller coming into contact with the first roller and thereby forming a nip portion in which a sheet is conveyed, the second rotation axis being inclined with respect to the first rotation axis; and a second conveyance unit having the same configuration as the first conveyance unit, wherein the second roller includes a first outer circumferential portion having a first outside diameter, a second outer circumferential portion arranged on one side of the first outer circumferential portion in an axial direction of the second rotation axis and having a second outside diameter larger than the first outside diameter, and a third outer circumferential portion arranged on the other side of the first outer circumferential portion in the axial direction of the second rotation axis and having a third outside diameter larger than the first outside diameter, wherein an outer circumferential surface of the first roller contacts with at least the first outer circumferential portion, the second outer circumferential portion, and the third outer circumferential portion of the second roller to form the nip portion, wherein the first conveyance unit is arranged on one side of a center of the sheet in a width direction of the sheet conveyed in the nip portion, and the first conveyance unit and the second conveyance unit are arranged symmetrically with respect to the center of the sheet in the width direction of the sheet.

2. An apparatus according to claim 1, wherein the first roller is driven by a driving source and the second roller is an idle roller rotated by the first roller.

3. An apparatus according to claim 1, wherein the second outside diameter is equal to the third outside diameter.

4. An apparatus according to claim 1, wherein the second roller is configured so that the outside diameter thereof gradually increases from the first outer circumferential portion toward the second outer circumferential portion and from the first outer circumferential portion toward the third outer circumferential portion.

5. An apparatus according to claim 1, wherein the second roller is arranged in a curved conveyance path.

6. An apparatus according to claim 1, wherein the second rotation axis is inclined so that the second rotation axis is further forward in a conveying direction of the sheet as the second rotation axis approaches a center of the sheet conveyed in the nip portion with respect to the width direction of the sheet.

7. An image forming apparatus, comprising:

an image forming unit configured to form a toner image;

a transfer unit configured to transfer the toner image formed by the image forming unit onto a sheet;

a fixing unit configured to fix the toner image transferred onto the sheet on the sheet; and a discharge unit configured to discharge the sheet, the discharge unit provided on a downstream side in a sheet conveyance direction in which a sheet is conveyed, wherein the discharge unit includes:

a first roller configured to rotate around a first rotation axis; and a second roller configured to rotate around a second rotation axis, the second roller coming into contact with the first roller and there by forming a nip portion in which a sheet is conveyed, the second rotation axis being inclined with respect to the first rotation axis, wherein the second roller includes a first outer circumferential portion having a first outside diameter, a second outer circumferential portion arranged on one side of the first outer circumferential portion in an axial direction of the second rotation axis and having a second outside diameter larger than the first outside diameter, and a third outer circumferential portion arranged on the other side of the first outer circumferential portion in the axial direction of the second rotation axis and having a third outside diameter larger than the first outside diameter, and wherein an outer circumferential surface of the first roller contacts with at least the first outer circumferential portion, the second outer circumferential portion, and the third outer circumferential portion of the second roller to form the nip portion.

8. An image forming apparatus according to claim 7, wherein the first roller is driven by a driving source and the second roller is an idle roller rotated by the first roller.

9. An image forming apparatus according to claim 7, wherein the second outside diameter is equal to the third outside diameter.

10. An image forming apparatus according to claim 7, wherein the second roller is configured so that the outside diameter thereof gradually increases from the first outer circumferential portion toward the second outer circumferential portion and from the first outer circumferential portion toward the third outer circumferential portion.

11. An image forming apparatus according to claim 7, wherein a first conveyance unit having the first roller and the second roller is arranged on one side of a center of the sheet in a width direction of the sheet conveyed in the nip portion, and the first conveyance unit and a second conveyance unit having the same configuration as the first conveyance unit are arranged symmetrically with respect to the center of the sheet in the width direction of the sheet.

12. An image forming apparatus according to claim 7, wherein a length of the second roller is shorter in a width direction perpendicular to the sheet conveyance direction than a length of the sheet in the width direction.

* * * * *